US007896516B1

(12) United States Patent
Zhu

(10) Patent No.: US 7,896,516 B1
(45) Date of Patent: Mar. 1, 2011

(54) NATURAL APPEARING TWIG LIGHTS

(76) Inventor: Jianrong Zhu, Rowland Heights, CA (US)

( * ) Notice: Subject to any disclaimer, the term of this patent is extended or adjusted under 35 U.S.C. 154(b) by 257 days.

(21) Appl. No.: 12/168,090

(22) Filed: Jul. 4, 2008

Related U.S. Application Data

(60) Provisional application No. 61/037,310, filed on Mar. 17, 2008.

(51) Int. Cl.
*F21S 6/00* (2006.01)

(52) U.S. Cl. ..... 362/123; 362/122; 362/249.06; 362/249.18

(58) Field of Classification Search ..... 362/122, 362/123, 806, 249.04, 249.06, 249.18
See application file for complete search history.

(56) References Cited

U.S. PATENT DOCUMENTS 3,544,783 A * 12/1970 Williams, Sr. ..... 362/123
5,899,555 A * 5/1999 Lin ..... 362/122
6,830,365 B2 * 12/2004 Kao ..... 362/567
7,073,932 B2 * 7/2006 Wainwright ..... 362/565
7,088,895 B2 * 8/2006 Peng et al. ..... 385/115
7,108,391 B2 * 9/2006 Chuang ..... 362/122
2006/0044822 A1 * 3/2006 Katsumata ..... 362/564

* cited by examiner

*Primary Examiner*—Stephen F Husar
*Assistant Examiner*—James W Cranson
(74) *Attorney, Agent, or Firm*—Michael D. Eisenberg

(57) ABSTRACT

The present invention is directed toward a decorative artificial twig structure for displaying a lamp, comprising a bendable rod serving as a structural foundation, an electrical wire, and a decorative lamp connected to the electrical wire. The rod and electrical wire are bundled together and wrapped in a covering to a position on the bundle below an end of the lamp such that the lamp can emit light visible to a viewer of the decorative artificial twig structure. In another embodiment, the decorative artificial twig structure comprises a plurality of lamps, a plurality of electrical wires connected to the lamps, and a plurality of bendable rods serving as a structural foundation for the lamps and electrical wires.

2 Claims, 5 Drawing Sheets

NATURAL APPEARING TWIG LIGHTS

CROSS-REFERENCES TO RELATED APPLICATIONS

This application claims priority to U.S. Provisional Application Ser. No. 61/037,310, filed on Mar. 17, 2008, which is hereby incorporated herein by reference in its entirety.

TECHNICAL FIELD

The present invention relates to a lighting embodied in a natural looking configuration and appearance and, more particularly, some embodiments relate to a natural appearing twig having lights along the branches.

BACKGROUND OF THE INVENTION

The subject invention generally relates to small type lights configured in the shape of a branch or twig.

BRIEF SUMMARY OF EMBODIMENTS OF THE INVENTION

According to one embodiment of the invention, a decorative artificial twig structure for displaying a lamp comprises a bendable rod serving as a structural foundation, an electrical wire, and a decorative lamp connected to the electrical wire. The rod and electrical wire are bundled together and wrapped in a covering to a position on the bundle below an end of the lamp such that the lamp can emit light visible to a viewer of the decorative artificial twig structure.

In a further variant, the decorative artificial twig structure comprises a plurality of lamps, a plurality of electrical wires connected to the lamps, and a plurality of bendable rods serving as a structural foundation for the lamps and electrical wires. The electrical wires are bundled together with the plurality of bendable rods to form a decorative twig tree structure having a plurality of branches, and the electrical wires are bundled together with the plurality of bendable rods by a covering to a position below an end of each lamp such that each lamp can emit light visible to a viewer of the decorative twig tree structure.

In another variant, the plurality of lamps are disposed on the plurality of branches. In one variant, the lamps are spaced equidistantly on the plurality of branches.

In a further variant, the lamps comprise a light housed in a protective plastic covering comprising a top part, a bottom part, and a step shape connecting the top and bottom parts so as to form a cavum to house the light, and the protective plastic covering is filled with transparent glue.

In yet another variant, the covering comprises a shrinkable plastic tube.

In a further variant, the covering comprises a water repelling paper having adhesive on one or more sides, and the covering is wrapped around the plurality of electrical wires and plurality of rods by a plurality of turns of the covering around the electrical wires and rods. In yet a further variant, a lamp protrudes from the bundled rod and electrical wire between a turn of the covering.

In another variant, the lamp is free of the rod and covering.

In a further variant of the decorative twig tree structure, at least one branch comprises at least two rods. In an additional variant, the decorative artificial twig tree structure comprises a trunk comprising the plurality of rods and electrical wires bundled together.

In one variant of the decorative artificial twig tree structure, the electrical wire is covered in a protective sheath.

In a further variant, the plurality of rods bundled with the electrical wire comprises a trunk and the plurality of decorative artificial twig tree structures comprise a plurality of trunks connected by an electrical wire. In yet a further variant, the plurality of trunks in the plurality of decorative artificial twig tree structures are connected in mechanical series by the electrical wire. In an additional variant, the plurality of trunks of the plurality of decorative artificial twig tree structures are electrically connected in parallel.

According to another embodiment of the invention, a method of displaying a decorative lamp comprises placing an electrical wire leading to a lamp adjacent to a bendable rod, wrapping the bendable rod and wire together with a covering to form a bundle, and positioning the lamp to protrude from between the covering and the rod so that an end of the lamp is free of the covering and can emit visible light.

In a variant of the method of displaying a decorative lamp, a plurality of electrical wires, each wire leading to a lamp, is placed adjacent to a plurality of bendable rods. In a further variant of the method, the plurality of bendable rods and plurality of wires are wrapped to form branches comprising a bendable rod wrapped with a wire, wherein the branches join to form a trunk comprising the plurality of bendable rods and wires. In yet a further variant of the method, the plurality of trunks are connected with an electrical wire.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
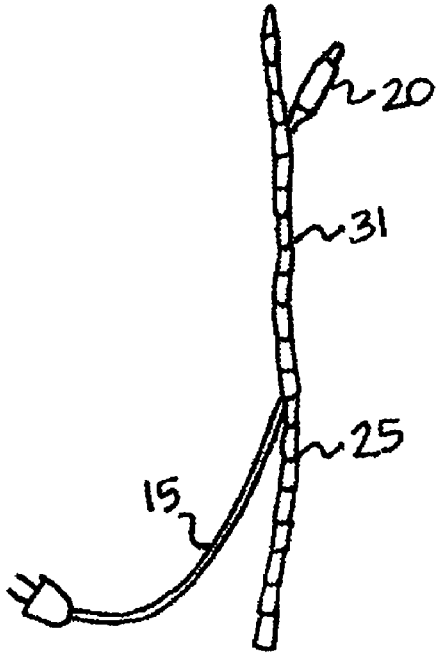
FIG. 1 is an illustration of a decorative artificial twig structure in accordance with the principles of the invention.
Figure 2:
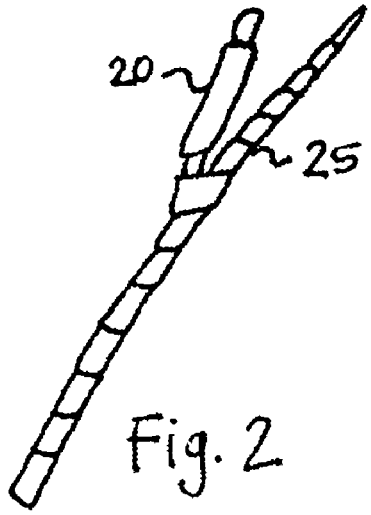
FIG. 2 is detailed view of a decorative artificial twig structure.

The present invention relates to lighting embodied in a natural looking configuration and appearance and, more particularly, some embodiments relate to a natural appearing twig having lights at the tips of the branches. In one embodiment of the present invention, referring to FIGS. 1-2 and 4, a decorative artificial twig structure for displaying a lamp comprises a bendable rod 10 serving as a structural foundation, an electrical wire 15, and a decorative lamp 20 connected to the electrical wire, wherein the rod 10 and electrical wire 15 are bundled together and wrapped in a covering 25 to a position on the bundle below an end of the lamp 20 such that the lamp 20 can emit light visible to a viewer of the decorative artificial twig structure.

Figure 3:
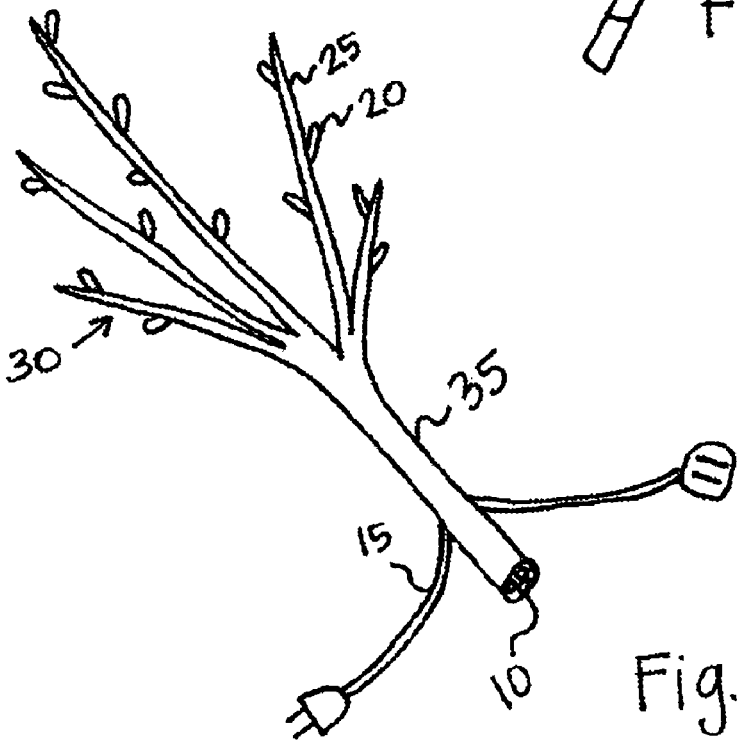
FIG. 3 is an illustration of a decorative artificial twig tree structure.

In a further variant, referring to FIG. 3, the decorative artificial twig structure further comprises a plurality of lamps 20, a plurality of electrical wires 15 connected to the lamps, and a plurality of bendable rods 10 serving as a structural foundation for the lamps 20 and electrical wires 15. The electrical wires 15 are bundled together with the plurality of bendable rods 10 to form a decorative twig tree structure having a plurality of branches 30. Moreover, the electrical wires 15 are bundled together with the plurality of bendable rods 10 by a covering 25 to a position below an end of each lamp 20 such that each lamp can emit light visible to a viewer of the decorative twig tree structure.

In another variant, the plurality of lamps 20 are disposed on the plurality of branches 30. In one variant, the lamps 20 are spaced equidistantly on the plurality of branches 30.

In a further variant, the lamps 20 comprise a light 24 housed in a protective plastic covering comprising a top part 21, a bottom part 22, and a step shape 23 connecting the top and bottom parts so as to form a cavum to house the light 24, and wherein the protective plastic covering is filled with transparent glue 36.

Figure 6:
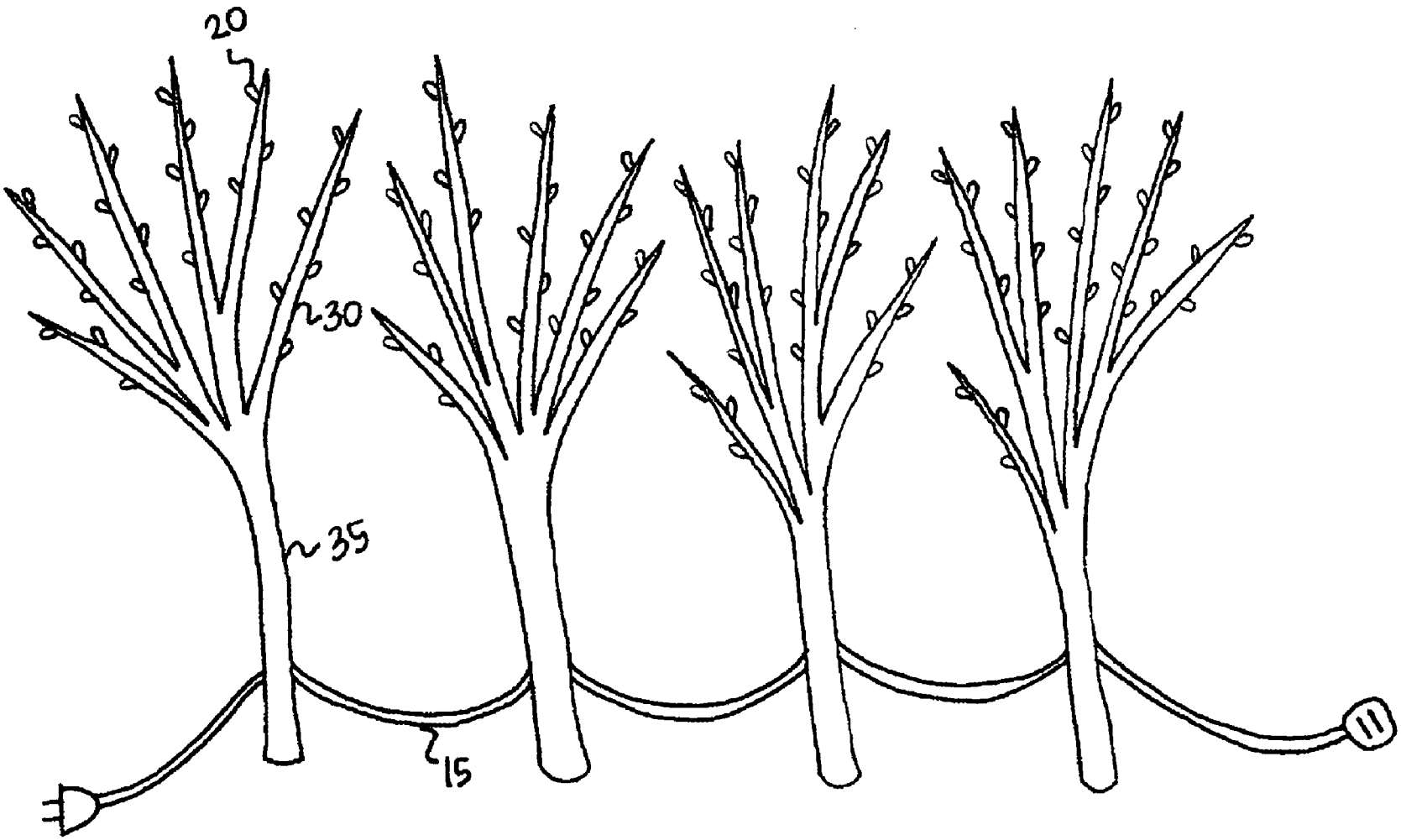
FIG. 6 is an illustration of a plurality of decorative artificial twig tree structures.

In yet another variant, referring to FIGS. 3 and 6, the covering 25 comprises a shrinkable plastic tube. In a further variant, referring to FIGS. 1-4 and 6, the covering 25 comprises a water repelling paper having adhesive on one or more sides, and the covering 25 is wrapped around the plurality of electrical wires 15 and plurality of rods 10 by a plurality of turns 31 of the covering 25 around the electrical wires and rods. In yet a further variant, a lamp 20 protrudes from the bundled rod 10 and electrical wire 15 between a turn of the covering 25.

In another variant, the lamp 20 is free of the rod 10 and covering 25.

In a further variant of the decorative twig tree structure, referring to FIGS. 3 and 6, at least one branch 30 comprises at least two rods 10. In an additional variant, the decorative artificial twig tree structure comprises a trunk 35 comprising the plurality of rods 10 and electrical wires 15 bundled together.

In one variant of the decorative artificial twig tree structure, the electrical wire 15 is covered in a protective sheath.

In a further variant, the plurality of rods 10 bundled with the electrical wire 15 comprises a trunk 35 and the plurality of decorative artificial twig tree structures comprises a plurality of trunks 35 connected by an electrical wire 15. In yet a further variant, the plurality of trunks 35 in the plurality of decorative artificial twig tree structures are connected in mechanical series by the electrical wire 15. In an additional variant, the plurality of trunks 35 of the plurality of decorative artificial twig tree structures are electrically connected in parallel.

Figure 4:
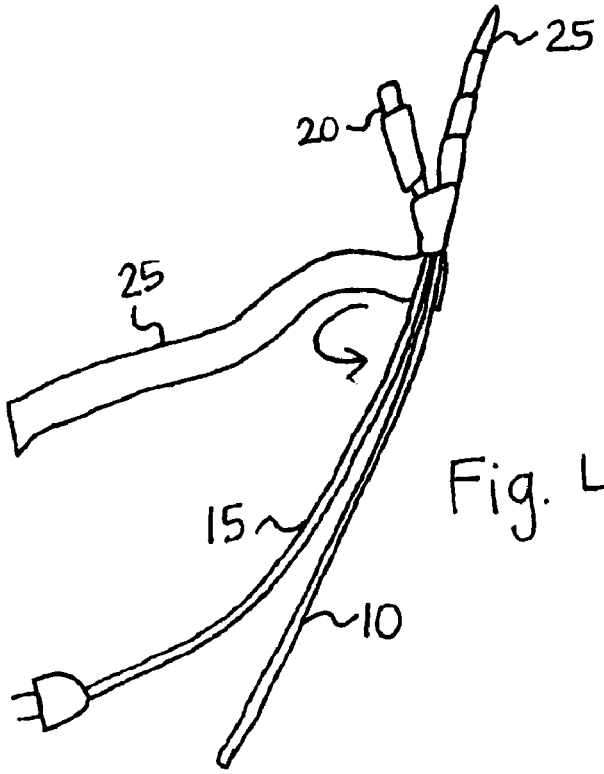
FIG. 4 is an illustration of the decorative artificial twig structure of FIG. 1 with the covering only partially wrapped around the bundled rod and electrical wire.
Figure 5:
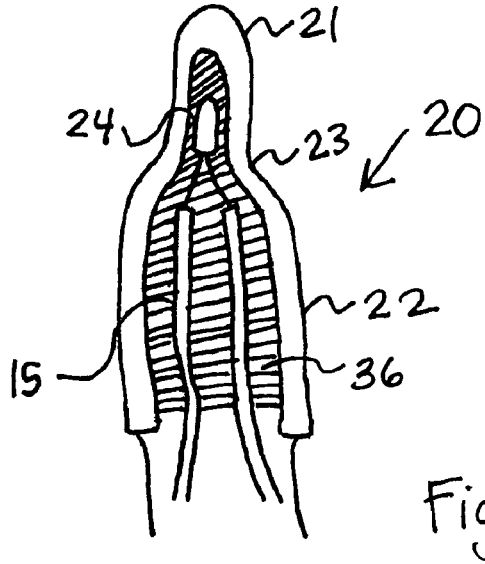
FIG. 5 is an illustration of a lamp of the decorative artificial twig structure in which the light is housed in a plastic protective covering.
Figure 7:
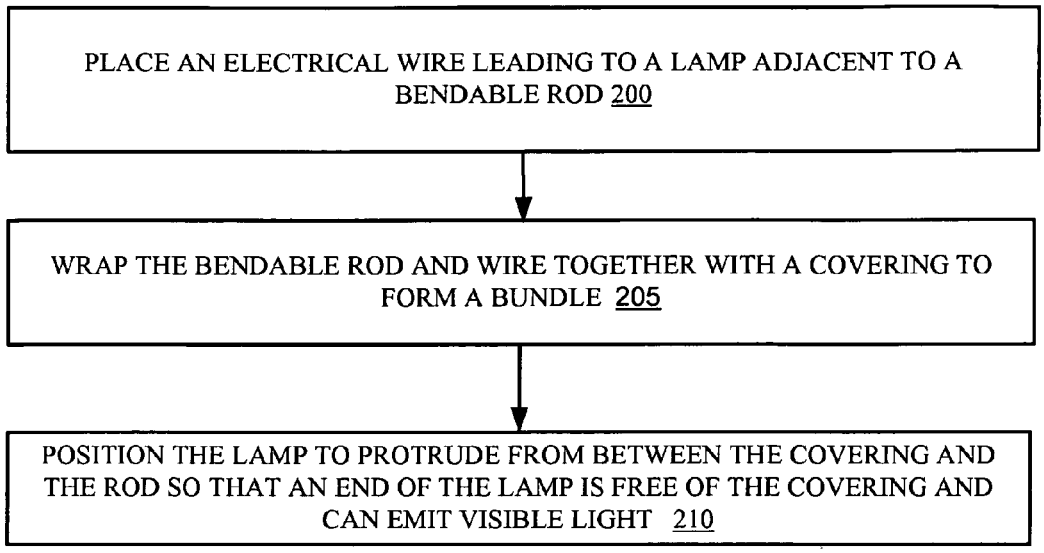
FIG. 7 is a flow chart illustrating a method of displaying lamps on an artificial twig tree structure.

According to another embodiment of the invention, referring to FIGS. 4 and 7, a method of displaying a decorative lamp comprises in a step 200 placing an electrical wire 15 leading to a lamp 20 adjacent to a bendable rod 10; in a step 205 wrapping the bendable rod 10 and wire 15 together with a covering 25 to form a bundle; and in a step 210 positioning the lamp 20 to protrude from between the covering 25 and the rod 10 so that an end of the lamp 20 is free of the covering 25 and can emit visible light.

Figure 8:
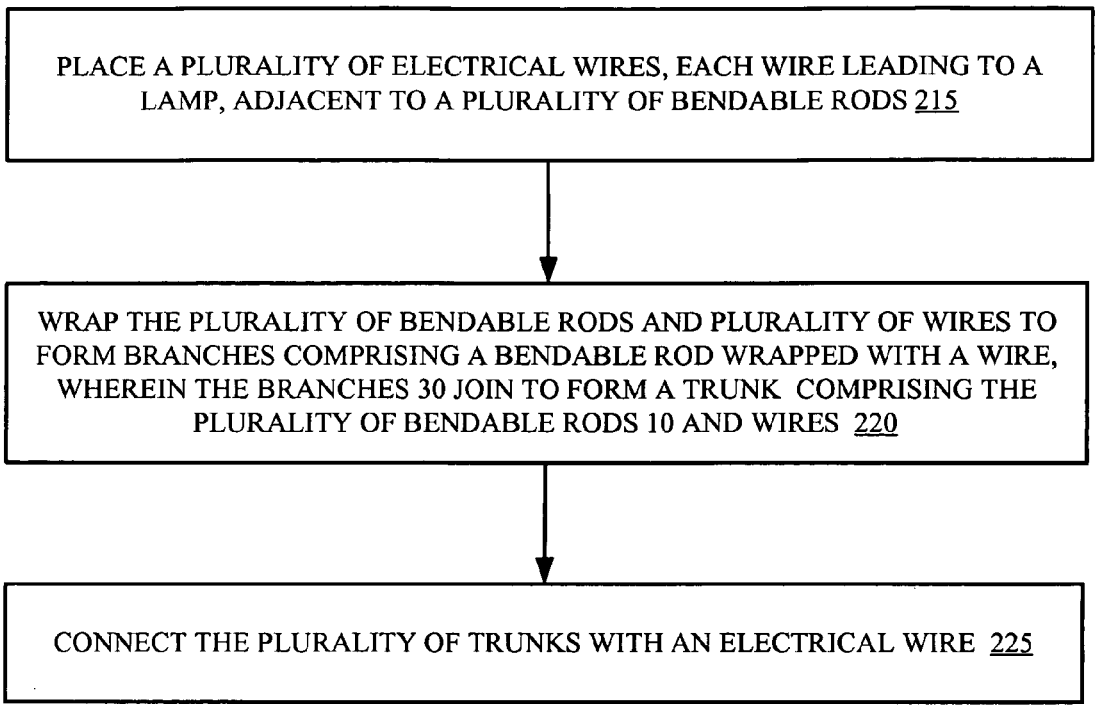
FIG. 8 is a flow chart illustrating a method of displaying lamps on a plurality of artificial twig tree structures.

In a variant of the method of displaying a decorative lamp, referring to FIG. 8, in a step 215 a plurality of electrical wires 15, each wire leading to a lamp 20, is placed adjacent to a plurality of bendable rods 10. In a step 220, the plurality of bendable rods 10 and plurality of wires 15 are wrapped to form branches 30 comprising a bendable rod 10 wrapped with a wire 15, wherein the branches 30 join to form a trunk 35 comprising the plurality of bendable rods 10 and wires 15. In a step 225, the plurality of trunks 35 are connected with an electrical wire 15.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A decorative artificial twig structure for displaying lamps, comprising:

a plurality of lamps;

a plurality of electrical wires connected to the lamps; and a plurality of bendable rods serving as a structural foundation for the lamps and electrical wires;

wherein the electrical wires are bundled together with the plurality of bendable rods to form a decorative twig tree structure having a plurality of branches; and wherein the electrical wires are bundled together with the plurality of bendable rods by a covering to a position below an end of each lamp such that each lamp can emit light visible to a viewer of the decorative twig tree structure;

wherein the covering comprises a water repelling paper having adhesive on one or more sides, and wherein the covering is wrapped around the plurality of electrical wires and plurality of rods by a plurality of turns of the covering around the electrical wires and rods.

2. A decorative artificial twig structure for displaying lamps, comprising:

a plurality of lamps;

a plurality of electrical wires connected to the lamps; and a plurality of bendable rods serving as a structural foundation for the lamps and electrical wires;

wherein the electrical wires are bundled together with the plurality of bendable rods to form a decorative twig tree structure having a plurality of branches; and wherein the electrical wires are bundled together with the plurality of bendable rods by a covering to a position below an end of each lamp such that each lamp can emit light visible to a viewer of the decorative twig tree structure;

wherein the covering comprises a shrinkable plastic tube; wherein a lamp protrudes from the bundled rod and electrical wire between a turn of the covering.

* * * * *